US010577803B2

(12) United States Patent
Pendley et al.

(10) Patent No.: US 10,577,803 B2
(45) Date of Patent: Mar. 3, 2020

(54) SUPPORTING A LOAD ON A ROOF

(71) Applicant: T&M Inventions, LLC, McFarland, WI (US)

(72) Inventors: Timothy Pendley, Madera, CA (US); Michael J. McLain, McFarland, WI (US)

(73) Assignee: T&M Inventions, LLC, McFarland, WI (US)

( * ) Notice: Subject to any disclaimer, the term of this patent is extended or adjusted under 35 U.S.C. 154(b) by 0 days.

(21) Appl. No.: 16/545,994

(22) Filed: Aug. 20, 2019

(65) Prior Publication Data

US 2020/0002949 A1 Jan. 2, 2020

Related U.S. Application Data

(63) Continuation of application No. 15/884,000, filed on Jan. 30, 2018, now Pat. No. 10,385,570, which is a (Continued)

(51) Int. Cl.
*E04D 13/03* (2006.01)
*E04D 3/30* (2006.01)

(52) U.S. Cl.
CPC ..... *E04D 13/0315* (2013.01); *E04D 3/30* (2013.01); *E04D 13/031* (2013.01); *E04D 13/0305* (2013.01)

(58) Field of Classification Search
CPC ..... E04D 13/031; E04D 13/0305; E04D 13/0315; E04D 3/30; E04D 3/28
See application file for complete search history.

(56) References Cited

U.S. PATENT DOCUMENTS 853,897 A * 5/1907 Porter ..... E04D 13/0481 52/24
3,521,414 A * 7/1970 Malissa ..... E04D 13/031 52/107

(Continued)

FOREIGN PATENT DOCUMENTS

GB 981948 2/1965
JP 2000-336859 5/2000

(Continued)

OTHER PUBLICATIONS

Cross-section and pictorial views of SSR-TUF-LITE daylighting panels, received Jun. 20, 2012, 1 sheet.

(Continued)

*Primary Examiner* — Andrew J Triggs
(74) *Attorney, Agent, or Firm* — Stephen C. Jensen; Northwind IP Law, S.C.

(57) ABSTRACT

The invention provides a system for installing a load on a metal panel roof, the system comprising a rail and closure structure adapted to be supported by ribs defined by the roof panels, and a load adapted to be supported on the rail and closure structure. In some embodiments, standing seams on ribs, and side rails on the rail and closure structure, extend parallel to each other, and optionally parallel to opposing sides of a hole in the roof. In some embodiments, substantially all of a downwardly-directed force of the load passes downwardly through the rail and closure structure to the ribs, and from the ribs to underlying structural members of the building.

20 Claims, 18 Drawing Sheets

Related U.S. Application Data continuation of application No. 14/482,471, filed on Sep. 10, 2014, now abandoned, which is a continuation of application No. 13/771,746, filed on Feb. 20, 2013, now Pat. No. 8,833,009, which is a continuation of application No. 12/932,892, filed on Mar. 8, 2011, now Pat. No. 8,438,798, which is a continuation-in-part of application No. 12/572,176, filed on Oct. 1, 2009, now abandoned.

(60) Provisional application No. 61/102,333, filed on Oct. 2, 2008.

(56) References Cited

U.S. PATENT DOCUMENTS 3,791,088 A * 2/1974 Sandow ..... E04D 3/08 52/200
3,802,131 A * 4/1974 Resech ..... E04D 13/1415 52/60
3,828,494 A * 8/1974 Uhrhane ..... E04D 13/1475 52/15
3,967,423 A * 7/1976 Hammond ..... E04D 13/03 52/200
4,073,097 A 2/1978 Jentoft et al.
4,117,638 A * 10/1978 Kidd, Jr. ..... E04C 2/54 52/200
4,123,883 A * 11/1978 Barber, Jr. ..... F24S 80/40 52/200
4,155,206 A * 5/1979 Player ..... E04D 3/30 52/200
D259,812 S 7/1981 Smith
4,296,581 A * 10/1981 Heckelsberg ..... E04D 3/362 52/520
4,428,166 A 1/1984 Burghart
4,470,230 A * 9/1984 Weisner ..... E04D 13/0315 206/509
4,520,604 A * 6/1985 Halsey ..... E04D 13/031 52/200
4,543,753 A * 10/1985 Sonneborn ..... E04D 13/1475 52/15
4,559,753 A * 12/1985 Brueske ..... E04D 13/031 52/200
4,621,466 A * 11/1986 Sonneborn ..... E04D 13/1475 52/15
4,649,680 A * 3/1987 Weisner ..... E04D 3/28 52/200
4,682,454 A * 7/1987 Simpson ..... E04O 3/08 52/200
4,703,596 A * 11/1987 Sandow ..... E04B 7/00 52/200
4,730,426 A * 3/1988 Weisner ..... E04D 3/28 52/200
4,776,141 A * 10/1988 Powell ..... E04D 13/031 52/200
4,825,608 A * 5/1989 Makin ..... E04D 13/03 52/200
4,848,051 A * 7/1989 Weisner ..... E04D 13/031 52/200
4,860,511 A * 8/1989 Weisner ..... E04D 3/28 52/200
4,905,434 A 3/1990 McLain et al.
4,941,300 A * 7/1990 Lyons, Jr. ..... E04D 13/0315 52/200
4,972,638 A 11/1990 Minter
4,986,039 A * 1/1991 Weisner ..... E04D 13/031 52/200
5,018,333 A 5/1991 Bruhm
5,027,576 A * 7/1991 Gustavsson ..... E04D 13/1475 52/200
5,077,943 A * 1/1992 McGady ..... E04D 13/1475 52/219
5,323,576 A * 6/1994 Gumpert ..... E04D 3/34 52/200
5,355,644 A 10/1994 Gruhl et al.
5,511,354 A * 4/1996 Eidson ..... E04D 3/3608 52/544
5,522,189 A * 6/1996 Mortensen ..... E04D 13/02 52/200
5,553,425 A * 9/1996 Sampson ..... E04D 13/0315 52/198
5,561,953 A * 10/1996 Rotter ..... E04D 3/30 454/365
5,647,175 A 7/1997 Smyth
5,673,520 A * 10/1997 Yannucci, III ..... E04D 13/1475 285/42
5,675,940 A 10/1997 Bahar et al.
5,682,713 A * 11/1997 Weiss ..... E04D 13/031 403/231
5,706,610 A 1/1998 Mayle
5,778,626 A 7/1998 Pendley
5,896,711 A * 4/1999 McClure ..... E04D 13/0315 52/198
5,960,596 A * 10/1999 Lyons, Sr. ..... E04D 13/1415 52/198
5,983,588 A 11/1999 Haddock
6,052,956 A 4/2000 Hoy et al.
6,079,167 A * 6/2000 Voegele, Jr. ..... E04D 3/28 52/199
D431,174 S * 9/2000 Merideth ..... D8/354
6,151,838 A * 11/2000 Husein ..... E04D 13/02 52/200
6,226,945 B1 5/2001 Henry et al.
6,263,623 B1 * 7/2001 Weiss ..... E04D 13/02 49/463
D448,095 S * 9/2001 Merideth ..... D25/199
6,374,549 B1 4/2002 Mayle
6,640,508 B2 * 11/2003 Lindgren ..... E04D 13/02 49/504
D485,657 S 1/2004 Lewis et al.
6,716,237 B1 4/2004 Batt, Sr.
6,718,718 B2 4/2004 Haddock
6,775,951 B2 * 8/2004 Gumpert ..... E04D 3/28 52/200
6,848,220 B2 2/2005 Faurholdt et al.
6,966,157 B1 * 11/2005 Sandow ..... E04D 3/362 52/200
7,043,882 B2 * 5/2006 Gumpert ..... E04D 3/28 52/200
7,069,704 B2 7/2006 Pendley
7,263,807 B2 * 9/2007 Gumpert ..... E04D 3/28 52/200
7,296,388 B2 * 11/2007 Valentz ..... E04D 13/0315 52/200
7,308,777 B2 * 12/2007 Sandow ..... E04D 3/362 52/200
7,331,145 B2 2/2008 Feucht et al.
7,386,958 B2 6/2008 Quarles
7,395,636 B2 * 7/2008 Blomberg ..... E04D 13/03 359/591
7,712,279 B2 * 5/2010 McClure ..... E04D 13/0315 52/200
7,721,493 B2 * 5/2010 Skov ..... E04D 13/03 52/200
7,736,014 B2 * 6/2010 Blomberg ..... E04D 13/033 359/591
7,882,664 B2 2/2011 Lundsgaard et al.
7,937,900 B1 5/2011 Gaffney et al.
7,980,182 B2 7/2011 Pendley
8,028,478 B2 * 10/2011 Valentz ..... E04D 13/0305 52/200
8,061,092 B2 * 11/2011 McClure ..... E04D 3/28 49/50
8,438,798 B2 * 5/2013 McLain ..... E04D 3/24 52/200
8,438,799 B2 * 5/2013 McLain ..... E04D 3/364 52/200
8,438,800 B2 * 5/2013 McLain ..... E04D 13/0315 52/200

(56) References Cited

U.S. PATENT DOCUMENTS 8,438,801 B2 * 5/2013 McLain ..... E04D 13/0481 52/200
8,448,393 B2 * 5/2013 Voegele, Jr. ..... E04D 13/0315 52/200
8,561,364 B2 10/2013 Pendley et al.
8,567,136 B2 * 10/2013 Pendley ..... E04D 3/24 52/200
8,763,324 B2 * 7/2014 Pendley ..... E04D 3/364 52/200
8,793,944 B2 * 8/2014 Blomberg ..... E04D 3/364 52/200
8,833,009 B2 * 9/2014 Pendley ..... E04D 3/24 52/200
8,844,216 B2 * 9/2014 Pendley ..... E04D 3/364 52/200
8,991,126 B2 3/2015 Pendley et al.
9,027,291 B2 5/2015 Pendley et al.
9,032,671 B1 * 5/2015 Pendley ..... E04D 13/0481 52/97
9,127,461 B2 * 9/2015 Pendley ..... E04D 3/352
9,163,419 B2 10/2015 Pendley
9,290,937 B2 3/2016 Pendley et al.
9,316,000 B2 * 4/2016 Pendley ..... E04D 13/0481
9,441,377 B2 * 9/2016 Pendley ..... E04D 3/364
9,447,580 B2 9/2016 Points et al.
9,534,390 B2 1/2017 Pendley et al.
9,631,381 B2 4/2017 McLain
9,637,927 B2 * 5/2017 Pendley ..... E04D 3/352
9,677,279 B2 * 6/2017 Pendley ..... E04D 3/352
D794,216 S * 8/2017 Kastner ..... D25/48.7
9,725,916 B2 8/2017 McLain et al.
9,784,003 B2 10/2017 Pendley et al.
9,909,318 B2 * 3/2018 Nelson, Jr. ..... E04B 1/38
10,221,579 B2 3/2019 McLain
10,352,048 B2 * 7/2019 Pendley ..... E04D 13/0315
10,385,570 B2 * 8/2019 Pendley ..... E04D 3/30
2002/0026756 A1 * 3/2002 Gumpert ..... E04D 3/28 52/200
2004/0049996 A1 * 3/2004 Blomberg ..... E04D 13/03 52/200
2004/0093826 A1 5/2004 Pendley
2004/0111981 A1 6/2004 Faurholdt et al.
2005/0016090 A1 * 1/2005 Gumpert ..... E04D 3/28 52/200
2005/0076583 A1 4/2005 Quarles
2005/0204674 A1 * 9/2005 Marshall ..... E04D 3/364 52/544
2006/0070315 A1 * 4/2006 McClure ..... E04D 13/0315 52/200
2006/0123713 A1 6/2006 Faurholdt et al.
2006/0191230 A1 * 8/2006 Gumpert ..... E04D 3/28 52/519
2006/0272232 A1 12/2006 Fooks
2007/0000205 A1 1/2007 Pendley
2007/0094984 A1 * 5/2007 McClure ..... E04D 13/0315 52/580
2007/0101665 A1 * 5/2007 Sandow ..... E04D 3/362 52/200
2008/0040993 A1 * 2/2008 Valentz ..... E04D 13/0315 52/200
2008/0190050 A1 * 8/2008 McClure ..... E04D 3/28 52/200
2010/0162643 A1 * 7/2010 Blomberg ..... E04D 3/364 52/200
2010/0269426 A1 * 10/2010 Richter ..... E04D 13/0315 52/171.3
2011/0154751 A1 * 6/2011 Gumpert ..... E04D 3/34 52/200
2011/0252726 A1 * 10/2011 McLain ..... E04D 3/24 52/200
2011/0252727 A1 * 10/2011 McLain ..... E04D 3/364 52/200
2012/0233941 A1 * 9/2012 McLain ..... E04D 13/0315 52/200
2012/0233942 A1 * 9/2012 McLain ..... E04D 3/30 52/200
2012/0240491 A1 9/2012 Voegele, Jr. et al.
2013/0031855 A1 * 2/2013 Blomberg ..... E04D 3/364 52/199
2013/0167459 A1 * 7/2013 Pendley ..... E04D 3/24 52/200
2013/0219825 A1 * 8/2013 Pendley ..... E04D 3/24 52/710
2013/0239489 A1 * 9/2013 Pendley ..... E04D 3/364 52/97
2013/0239500 A1 * 9/2013 Pendley ..... E04D 13/031 52/302.1
2013/0239513 A1 * 9/2013 Pendley ..... E04D 13/0315 52/742.12
2013/0283725 A1 10/2013 Blomberg et al.
2013/0305623 A1 11/2013 Pendley et al.
2014/0020314 A1 * 1/2014 Pendley ..... E04D 3/364 52/200
2014/0109497 A1 * 4/2014 Pendley ..... E04D 3/364 52/200
2014/0260068 A1 * 9/2014 Pendley ..... E04D 13/031 52/710
2014/0331573 A1 11/2014 Blomberg et al.
2014/0352233 A1 12/2014 Pendley et al.
2014/0373463 A1 12/2014 Pendley et al.
2015/0013241 A1 1/2015 Pendley et al.
2015/0013248 A1 1/2015 Pendley et al.
2015/0259907 A1 9/2015 Points et al.
2015/0259908 A1 9/2015 Pendley et al.
2015/0259933 A1 9/2015 Pendley et al.
2015/0259934 A1 9/2015 McLain et al.
2015/0259935 A1 9/2015 McLain
2015/0259936 A1 9/2015 Pendley et al.
2015/0259937 A1 9/2015 Pendley
2015/0315792 A1 11/2015 Pendley et al.
2015/0330083 A1 11/2015 Pendley et al.
2017/0204625 A1 7/2017 McLain
2018/0106044 A1 4/2018 Pendley et al.
2018/0135305 A1 5/2018 Pendley et al.
2018/0202164 A1 7/2018 Pendley et al.

FOREIGN PATENT DOCUMENTS

JP 2001-214577 8/2001
JP 2008-202372 9/2008
WO WO 2010/040006 4/2010

OTHER PUBLICATIONS

Cross-section of VP TUF-LITE Panel—attached to the side of SSR rib, received Jun. 20, 2012, 1 sheet.
Cross-section of BUTLER LITE PANEL—attached to the side of MR24 rib, received Jun. 20, 2012, 1 sheet.
FAA Facility, photos of skylight installation, 3 pages, Sacramento, CA, prior to 2007.
Siemens Building, photos of skylight installation, 6 pages, prior to 2007.
R & S Manufacturing and Sales Company, Inc., Standing Seam 24 Light, Quick Installation Instructions, Under/Over Seam Clip, 12 pages, Newbury Park, CA, Aug. 2012.
R & S Manufacturing and Sales Company, Inc., SS 24 Light, The First Truely Thermally Broken Metal Building Skylight, informational sheet, 1 page, Newbury Park, CA, Aug. 2012.
R & S Manufacturing and Sales Company, Inc., Enlarged sketch of metal roof showing the down slope, 1 page, Newbury Park, CA, Aug. 2012.
Daljcon, LLC., Butler Manufacturing, www.daljcon.com, Example of 6 Layer Standing Seam, 1 page, printed Dec. 11, 2012.
Side Rails, used with thermal break, some showing thermal breaks,Technical Drawings, 15 pages, release and revision dates Jan. 10, 2014 to Apr. 30, 2014.
Front Diverter and Diverter Assemblies, Technical Drawings, 10 pages, release and revision dates Jan. 13, 2014 to Jan. 30, 2014.

(56) References Cited

OTHER PUBLICATIONS

Front and Rear Closures, Technical Drawings, 5 pages, release and revision dates Jan. 13, 2014 to Apr. 30, 2014.
PVC Thermal Break (for Extruded Side Rail), 2 pages, release and revision dates Jan. 10, 2014 to Mar. 26, 2014.

* cited by examiner

SUPPORTING A LOAD ON A ROOF

CROSS-REFERENCE TO RELATED APPLICATIONS

This application is a continuation of U.S. Ser. No. 15/884,000, "Supporting a Load on a Roof", filed Jan. 30, 2018 and now issued as U.S. Pat. No. 10,385,570 (Pendley et al.), which is a continuation of U.S. Ser. No. 14/482,471, "Support Structures and Methods of Mounting Loads on Roofs", filed Sep. 10, 2014 and now abandoned, which is a continuation of U.S. Ser. No. 13/771,746, "Rail Mounting Systems on Roofs", filed Feb. 20, 2013 and now issued as U.S. Pat. No. 8,833,009 (Pendley et al.), which is a continuation of U.S. Ser. No. 12/932,892, "Roof Penetrating Closure Structures and Systems", filed Mar. 8, 2011 and now issued as U.S. Pat. No. 8,438,798 (McLain et al.), which is a continuation-in-part of U.S. Ser. No. 12/572,176, "Curbless Multiple Skylight and Smoke Vent System", filed Oct. 1, 2009 and now abandoned, which claims priority under 35 U.S.C. § 119(e) to provisional patent application U.S. Ser. No. 61/102,333, "Multiple Skylight Curb System", filed Oct. 2, 2008, the contents of all such priority applications being incorporated herein by reference.

BACKGROUND OF THE INVENTION

Various systems are known for using curb construction for inserting skylights and smoke vents into roofs.

The most commonly used skylighting systems are those that incorporate translucent or transparent layers in a framework that penetrates the roof structure, so as to allow ambient daylight into the building.

In the past roof penetrating installations have required a complex structure beneath the roofing panels in order to support a roof curb to which the skylight was attached. Skylight curbs are generally in the form of a preassembled box structure, that is fixed within a roof cutout. The retrofitting of such curb systems into existing roof structure is problematic.

U.S. Pat. No. 4,296,581, to Heckelsberg, issued Oct. 27, 1981, provides an example of a roofing structure of the type that is constructed of a series of metal panels having flanges that interlock when the panels are laid side by side and which are subsequently tightly seamed together to convert the individual panels into an integrated roof forming membrane. This roof structure is mounted to the purlins with clips that permit the panels to expand or contract in response to temperature and pressure changes, thereby minimizing roof stressing.

U.S. Pat. No. 4,703,596, to Sandow, issued Nov. 3, 1987, and titled "Grid Skylight System", provides a grid skylight support apparatus that includes prefabricated grid row frames, each of which form a number of connected beam supports which define a number of bays. Each bay has a skylight curb formed by upper flanges of the beam supports to receive a preassembled skylight unit. The sides of each grid row frame provide a mating edge that can register with the mating edge of an adjacent grid row frame during assembly. The skylights have peripheral support skirts that register upon each bay and a light-transmitting skylight panel to cover the peripheral support. Cross gutters on each grid row frame, which are positioned between adjacent skylights, extend at an angle toward the mating edge of the grid row frame for carrying rainwater to a main gutter channel formed by field-assembly of the mating edges of two adjacent grid row frames. The main gutter channel includes a pair of longitudinally extending gutter sections, each of which have a main gutter channel surface with a lower elevation than the elevation of the cross flow channel. Fasteners assemble the grid row frame mating edges together and a continuous seal to prevent rainwater leakage at the mating edges of adjacent grid row frames.

U.S. Pat. No. 4,520,604, to Halsey et al., issued Jun. 4, 1985, entitled "Skylight Structure", teaches a curb structure that is dimensioned to be passed through an opening in a roof and then attached in moisture impervious relation to the roof from within a building interior. A skylight assembly including a frame and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaw includes a channel which engages and is interlocked with the curb structure.

Other skylight systems, as contemplated in U.S. Pat. No. 4,470,230, by Weinser, provide a prefabricated skylight support curb that is formed to be a protective packaging for the skylight during shipment and then used as a curb for mounting the skylight on a roof. A prefabricated skylight support curb for supporting a skylight thereover has a bottom flange angled, upright sides, and a top lip round the top of the sides forming an opening through the curb. A skylight is adapted to cover the opening through the skylight support curb when installed, and has a domed portion and an angled portion extending from the dome portion and a drip edge on the curb portion. The skylight curb portion is shaped to fit over a portion of the prefabricated skylight support curb angled upright portion and top lip. The skylight support curb is shaped to nest an accompanying skylight therein having the skylight curb portion adjacent to the interior of the skylight support curb angled upright walls to protect the skylight during shipping and storing.

In another skylight system, as contemplated in U.S. Pat. No. 3,791,088, by Sandow et al., a prefabricated multiple dome unit or skylights and composite is provided, wherein each multiple dome unit has several domes of transparent or translucent material mounted together on a common frame, and wherein means are provided for assembling a plurality of such dome units into a composite thereof on a building, with the units lapped and interfitted so as to provide a continuous drainage system discharging to the exterior of the units in the composite assembly.

In yet another skylight system, as contemplated in U.S. Pat. No. 4,642,466, by Sanneborn et al., a flashing frame is described for roof windows to be installed adjacent to each other with edges facing each other in the installed position with a connecting flange of its upper flashing members extending beneath the roofing and, if need be, with its lower flashing members and required intermediary flashing members, obliquely outwardly bent connecting webs and each with a connecting bar with supporting webs which rearwardly engage the connecting webs being adjacent to the width of the installation distance and are obliquely bent inwardly on both sides, and at least one inner projection which engages between the facing corner edges of the connecting webs in the installed position, thus maintaining these corner edges at the installation distance.

In today's world of mandated energy efficiency in all types of buildings the metal building industry needs a more economical and less detrimental way to use skylights and smoke vents to daylight their buildings. To ensure adequate daylighting, however, typical skylight and smoke vent installations require multiple roof penetrations that cut through and remove plural major elevations in standing seam and other roof panel profiles. These curbs create multiple opportunities for water to enter the interior of the building, due to multiple curb locations and the width of the curbs, as well as the challenge to effectively seal the roof at the high end of such curbs.

The traditional curb constructions and methods of attachment in most cases require a complicated support structure to be installed below the roof panel which can restrict movement associated with the thermal expansion and contraction of the metal roof due to temperature changes and the like.

None of the prior approaches have been able to provide an installation system for multiple skylights that accomplishes all the goals of economy and simplicity of installation and will work equally well for new buildings and as a retrofit in existing buildings.

SUMMARY OF THE INVENTION

This invention provides for supporting a load on a roof. In one aspect, the invention provides a curbless construction system for installing two or more adjacent skylights and smoke vents end to end onto the major rib elevation of a building's metal panel roof system. Numerous roof structures include such elevations, sometimes deemed "ribs" or "corrugations", including the standing seam, snap seam and "R" panel roof types. The rail and closure system is fastened to the metal roof panels along the rib structures, so that the system can move with the expansion and contraction of the roof.

The invention utilizes elements of the roof surface structure as an integral part of the skylight support structure. In the preferred embodiment, the system includes a rail and closure assembly adapted to be supported on a major rib elevation a metal roof, typically where the elevation has been cut to accommodate drainage. The balance of the rib is to provide structural support for the rail assemblies.

Also in the preferred embodiment, the skylight/smoke vent system includes a skylight adapted to be supported on the rail and closure assembly, and a bearing plate structure for supporting and sealing the portion of the elevations that have been cut away preventing water accumulation at the surface, thus preventing water egress into the building.

In a further preferred embodiment, the invention provides a skylight system (including smoke vents) where the bearing plate structure cooperates with the rail and closure assembly to close the cut away portion to water egress.

In another preferred embodiment, the invention provides a skylight system where the metal roof is selected from the group of roofs comprising a standing seam roof, an architectural standing roof and a snap seam roof.

In another preferred embodiment, the invention provides a skylight system where the rib has been cut in only one location.

In a further preferred embodiment, the invention provides a skylight system where the standing seam roof has trapezoidial rib elevations.

In still further preferred embodiment, the invention provides a skylight system where the ribs are about 24" to about 30" on center.

In a different preferred embodiment, the invention provides a skylight system where the metal roof is selected from the group of roofs comprising an architectural standing roof and a snap seam roof, and where the vertical rib configurations are about 12" to about 18" on center.

In still further preferred embodiment, the invention provides a skylight system where the metal roof is an exposed fastener roof system.

In one preferred embodiment, the invention provides a skylight system where the rib has been cut in two locations.

In a different preferred embodiment, the invention provides a skylight system having a trapezoidial or rectangular rib elevation 8" to 12" on center.

In another preferred embodiment, the invention provides a skylight system where the exposed fastener roof is of the type having roof panels fastened directly to the roof purlin from the top side of the roof panel.

In a further preferred embodiment, the invention provides a skylight system where the system comprises two or more skylights supported end to end.

In a different preferred embodiment, the invention provides a skylight system (including smoke vents) where each of the skylights are about 10 feet in length.

In one preferred embodiment, the invention provides a skylight system where the rail and closure assembly moves with the rib elevation.

In different preferred embodiment, the invention provides a skylight system further comprising a ridge cap configured to fit over the standing rib elevations at the ridge of the roof.

In a further preferred embodiment, the invention provides a skylight system where a lower closure of the skylight rail and closure assembly extends across the top of the metal roof panel profile.

In one preferred embodiment, the invention provides a skylight system where the closure is configured to match the roof panel surface adjacent rib elevations for sealing.

In a further preferred embodiment, the invention provides a skylight system where the closure is pre-cut to match the roof surface and adjacent rib elevations for sealing.

In a still further preferred embodiment, the invention provides a skylight system where the rail and closure assembly is fastened directly to the rib elevations using screws or rivets.

Where an extension is attached to the upper flange of the rail and closure assembly to effectively raise the height of the skylight or smoke vent to accommodate snow conditions and the like.

In a preferred embodiment, the invention provides a skylight system further comprising a safety security guard attached to the rail assembly.

In a still further preferred embodiment, the invention provides a skylight system where the rail and closure assembly comprises an extended down leg on the inside of the roof cut away segment.

In another preferred embodiment, the invention provides a skylight system where the rail and closure assembly forms a water tight seal with the rib elevation.

In a preferred embodiment, the invention provides a skylight system where a side rail elevation attaches to the interior of the rib elevation.

In a further preferred embodiment, the invention provides a skylight system where the side rail elevation attaches to the anterior of the rib elevation.

In a different preferred embodiment, the invention provides a skylight system where a portion of the adjacent rib elevation is cut away to accommodate drainage along the roof surface.

In a still further preferred embodiment, the invention provides a skylight system where a portion at only one adjacent rib elevation is cut away to accommodate drainage along the roof surface.

In another preferred embodiment, the invention provides a skylight system where a portion at two or more adjacent rib elevations is cut away to accommodate drainage along the roof surface.

These and other features and advantages of this invention are described in, or are apparent from, the following detailed description of various exemplary embodiments of the apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

DETAILED DESCRIPTION OF ILLUSTRATIVE EMBODIMENTS

The products and methods of the present invention provide a skylight rail and closure system for use in installing various roof penetrating structures in metal roofs. For purposes of simplicity, "roof penetrating structures" and "skylights" will be used interchangeably to mean various forms of roof structures installed for passage of light and/or ventilation to the interior of the building. In the case of roof ventilation, examples include simple ventilation openings, such as for roof fans, and smoke vents, which are used to allow the escape of smoke through the roof during fires.

The number of skylights can vary from one to many structures connecting end to end be from one to as many as the building roof structure will support, limited only by the amount of support provided by the roof surface structure, which is left largely intact during the installation process.

The system utilizes the major rib structure in the roof as the primary support structure and water barrier to fasten the skylight assembly. Typical skylight installations do not allow for continuous runs, but use a curb construction that is typically 2-3 times wider than the present system.

The present skylight system does not require a complex structure underneath the panels or a separate curb construction to support or attach the skylight. The rail and closure assembly is overlaid onto the roof system and allows for thermal expansion and contraction by utilizing the major profiles of the metal roof panel for support. This is accomplished through direct attachment of the rail assembly and a combination of the panel flat and major ribs for support and attachment of the closure assembly.

In reference now to the figures, the system allows the installation of two or more adjacent skylights in an end to end fashion along the major rib structure of a building's metal roof panel profile.

Figure 1:
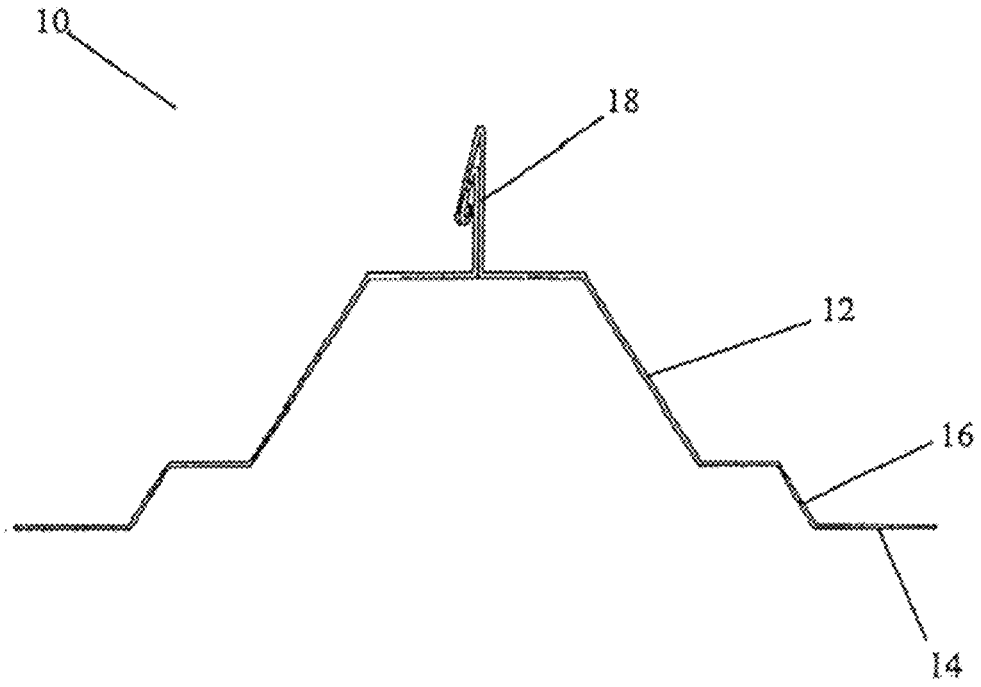
FIG. 1 is a view showing the roof profile of a metal roof of the type known as the standing seam roof panel.

The skylight system may be applied to various types of ribbed roof profiles. FIG. 1 is a view showing the roof profile of a metal roof of the type known as the standing seam roof panel 10. These include the "standing seam" roof, which has trapezoidal major ribs 12 typically 24" to 30" on center. Each panel 10 will also include the panel flat 14, having a shoulder 16 and seamed at adjacent panels forming a standing seam 18, which is folded over and seamed to prevent water from penetrating the roof.

Figure 2:
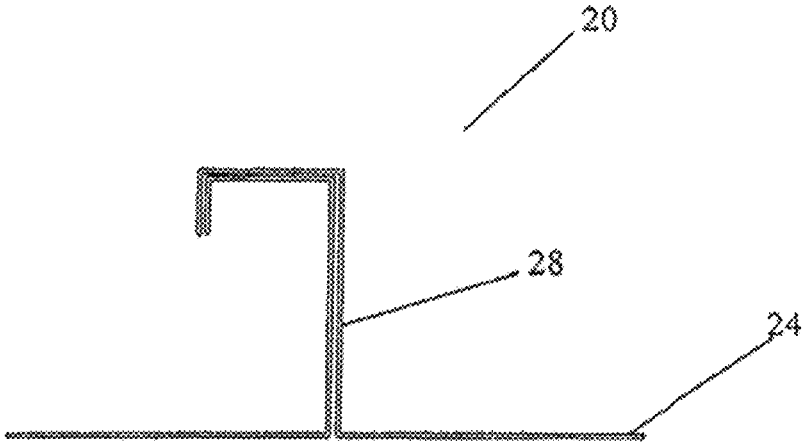
FIG. 2 is a view showing the roof profile of a metal roof of the type known as an architectural standing seam roof.

FIG. 2 is a view showing the roof profile of a metal roof of the type known as an architectural standing seam roof, produced of a series of overlapping architectural standing seam panels 20. Each panel 20 comprises a panel flat 24, with an architectural standing seam 28 formed at the interconnecting panels.

Figure 3:
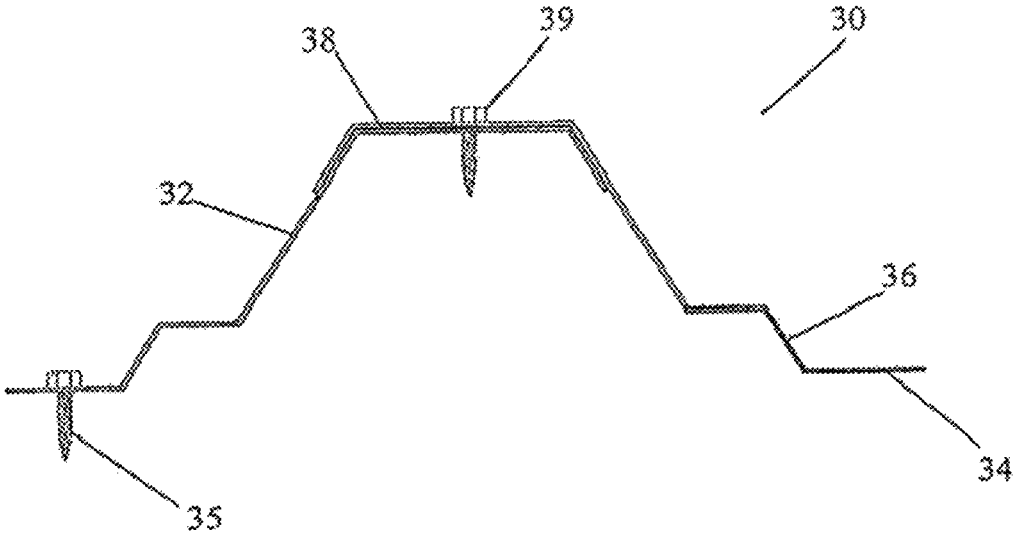
FIG. 3 is a view showing the roof profile of a metal roof of the type commonly referred to as a snap seam roof.

FIG. 3 is a view showing the roof profile of a metal roof of the type commonly referred to as an R panel or exposed fastener panel 30, with each panel having a rib 32, panel flat 34. Adjacent R panels are secured to the roof through a structural fastener 35, and at the shoulder 36 which is formed from overlapping regions, or side lap 38, the adjacent panels are secured through a stitch fastener 39. The trapezoidal major ribs of the R panel roof are most typically formed at 8" to 12" on center.

Figure 4:
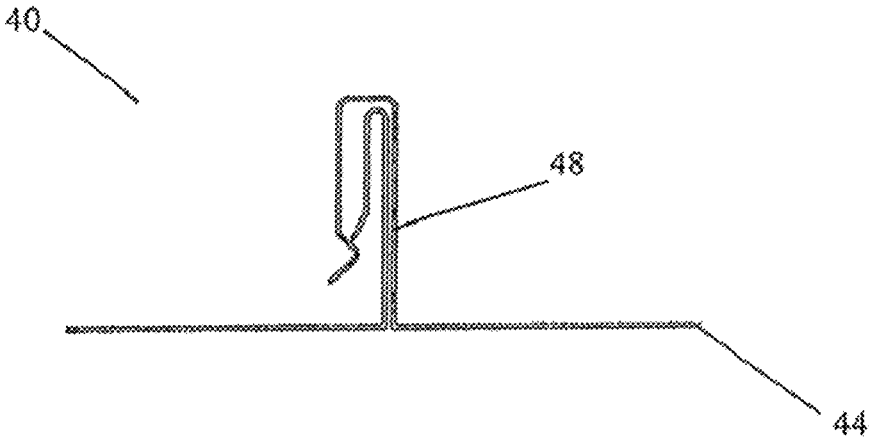
FIG. 4 is a view showing the roof profile of a metal roof of the type commonly referred to as an exposed fastener roof panel.

FIG. 4 is a view showing the roof profile of a metal roof of the type commonly referred to as a snap rib seam panel 40. Snap seam panels 40 have a panel flat 44 and a standing seam or snap seam 48 at adjacent panels.

Figure 5:
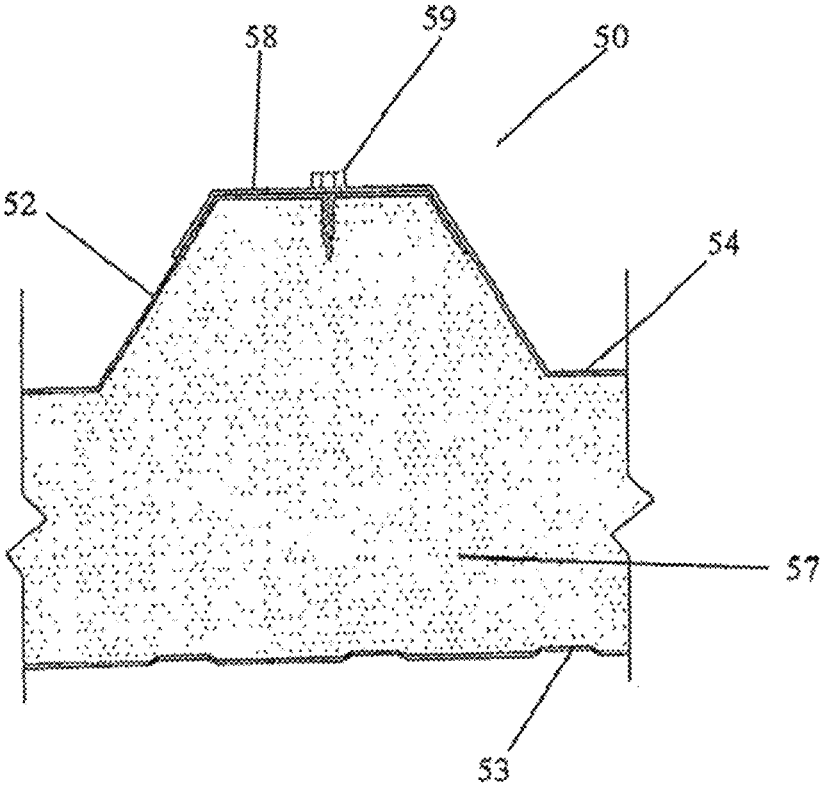
FIG. 5 is a view showing the roof profile of a metal roof of the type commonly known as foam core panel.

FIG. 5 is a view showing the roof profile of a metal roof of the type commonly known as foam core panel 50, which has a rib 52, a liner panel 53, a panel flat 54 and a foam core 57. Side laps 58 are secured by a stitch fastener 59. This panel is typically installed from the interior of the building.

The system includes a rail and closure assembly adapted to be supported onto the major elevations, seams, rib structures, or other structural elements of such roof profiles, where the standing structure provides the support, and the skylight is secured through an opening formed in the intervening, non-structural roof flat region.

Figure 6:
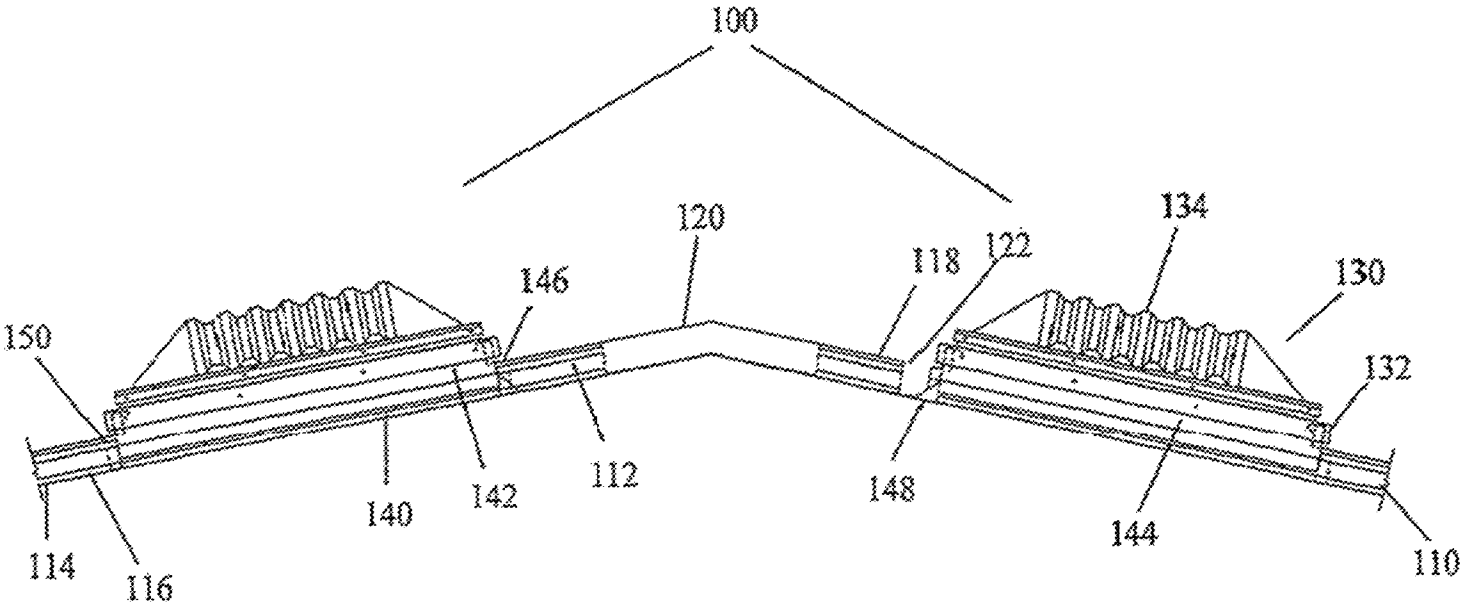
FIG. 6 is a side view showing the major components of the system as installed on a metal roof.

Turning now to FIG. 6, there is shown an exemplified rail and closure assembly 100 adapted for attachment to a standing seam panel roof 110. While the following figures depict such an assembly, it will be understood that the components could easily be adapted, by shaping of the elements, for attachments to any roof system that has a profile with elevations providing a place for structural support.

Figure 7:
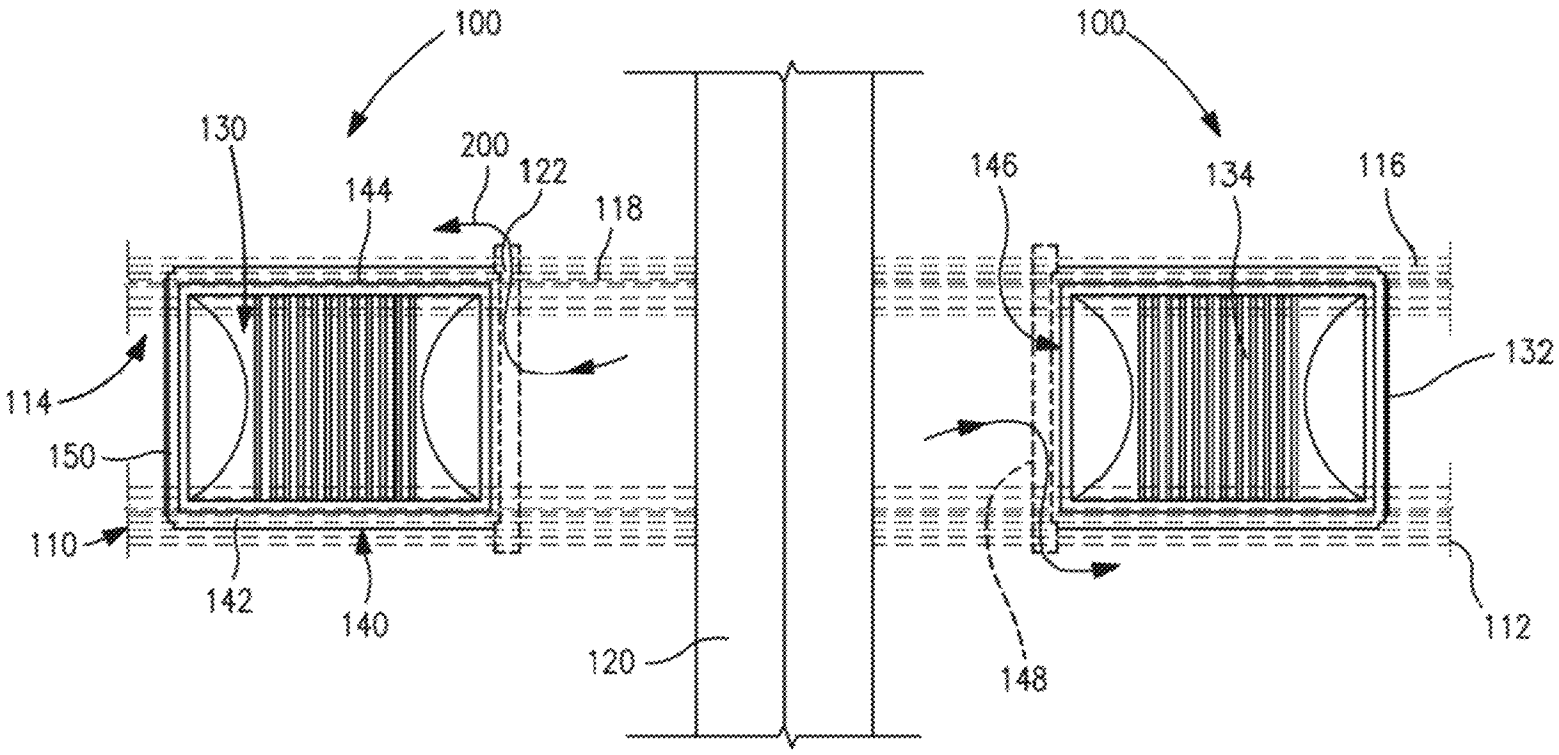
FIG. 7 is a top plan view of the installed system, showing the placement of skylights and the direction of water flow over the roof.

Looking again to the figures, particularly FIGS. 6 and 7, there is shown such a standing seam panel roof 110 having structural and other elements including a raised rib 112, a panel flat 114, shoulder 116 and standing seam 118. Also depicted are the ridge cap 120 of the roof structure, and a series of cutaway regions, or gaps 122 formed to accommodate the structure, as described more fully as follows.

Shown as part of the system, and exemplified in this case, is a skylight 130, generally comprising a skylight frame 132 and skylight lens 134. While the figures depict a skylight, it will be understood that the system could also be adapted for use with any number of roof penetrating structures, from various types of skylights to smoke vents or other loads or other ventilating structures, which can all be adapted to be supported on the rail and closure assembly system.

Again in reference to FIGS. 6 and 7, the system includes a rail and closure structure 140, generally comprised of side rails 142 and 144, and upper diverter 146 disposed at the rib cutaway section, or gap 122. FIGS. 6 and 7, collectively, show the rail 142 being mounted to the rib by rivets 310 at leading, intermediate, and trailing portions of the length of the rail. At this gap 122, a plate 148 may be located under the gap 122 to prevent water leakage from roof. In assembling the rail and closure structure to a roof, the plate 148 may be sealed and fastened securely to the roof panel supports.

Looking more particularly to FIG. 7 it is shown how the gap 122 in the roof rib 112 allows water flow 200 along the roof surface, over plate 148, and down and away from the roof ridge cap 120.

The rail and closure assembly structure 140 may also include a lower closure 150 to seal the system from the elements.

Figure 8:
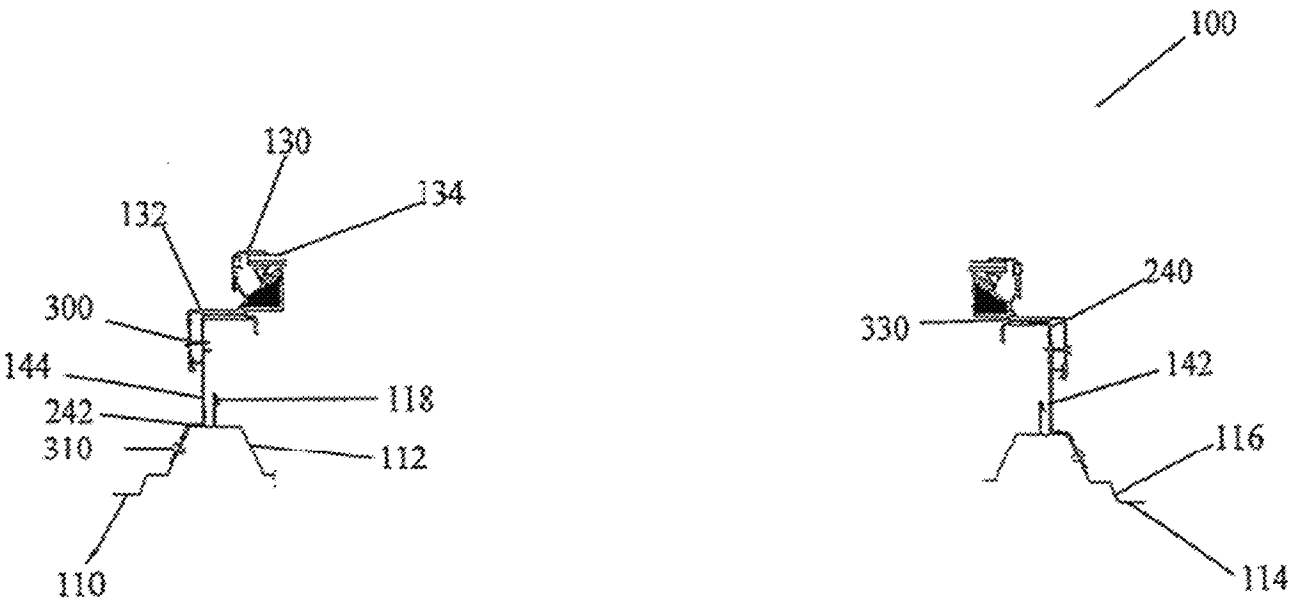
FIG. 8 is a cross sectional view showing the connections of the skylight frame to the rail and closures structure, and the latter affixed over the outer surfaces of adjacent rib elevations of the metal roof.

In reference now to FIG. 8, there is shown a cross section through the skylight 130 region of the rail and closure structures 100, showing the securement of the assembly 100 to the standing seam panel roof 110.

FIGS. 6 and 7 illustrate the skylight load length extending in the same direction as the roof ribs 112. FIG. 8 illustrates the skylight load width. FIGS. 6-8 show the skylight load being separate and distinct from the rail and closure structure 140. FIGS. 6 and 7 also show the rails extending substantially the full length of the skylight load. FIG. 8 shows rails 142, 144 contacting respective underlying ones of the ribs and extending upwardly from the underlying ribs, and supporting the skylight load; and the underlying ribs supporting the rails along substantially the full length of the skylight load.

Figure 11:
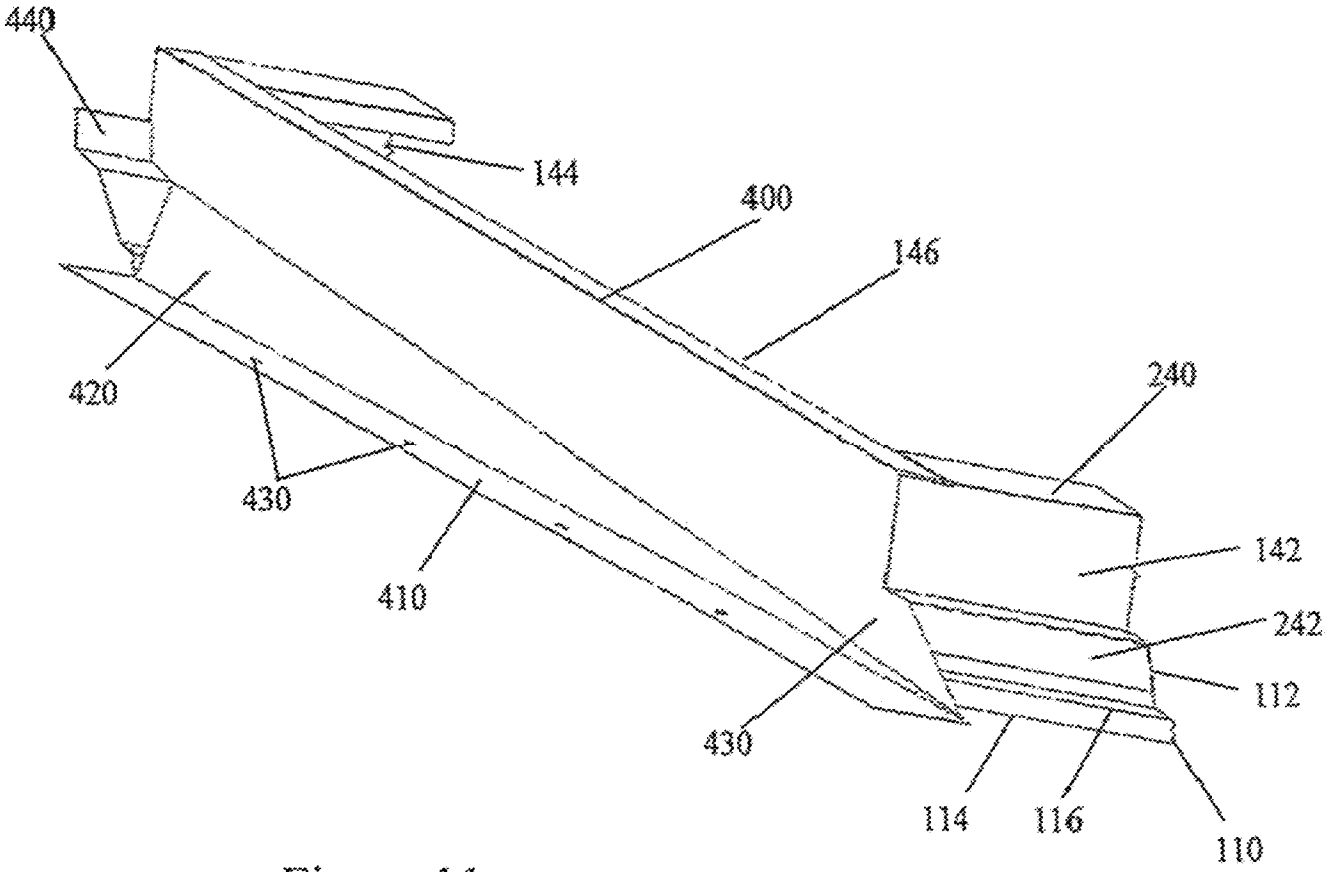
FIG. 11 is a perspective view of the upper rain pan or diverter of the rail and closure structure.

In particular, FIG. 8 depicts the use of the ribs 112 to support the side rails 142 and 144 on opposing sides of panel flat 14. It is seen that each of rail 142, rail 144, and upper diverter 146 has an upper support flange defining an upper bearing surface 240 at a common elevation above the panel flat of a next adjacent roof panel, supported by a generally vertically upstanding web. Rails 142, 144 have lower shoulders 242 supporting the upstanding webs. FIG. 11 shows the upper bearing surfaces of the diverter and the rails at a common elevation.

FIG. 6, in combination with FIG. 8, shows that rails 142 and 144 extend substantially the full length of the overlying skylight load, and that the skylight load is secured to the underlying rails by fasteners 300 spaced along the lengths of the rails. The rails 142 and 144 extend upwardly from and above the ribs in contacting and supporting the load, whereby substantially all of the downwardly-directed force of the load passes downwardly through the rails at the vertically upstanding webs, as elements of the rails, and from the rails downwardly to the underlying ones of the ribs, and from the ribs downwardly to structural support members of the building. Particularly as illustrated in FIG. 7, as supported by FIGS. 6, 8, and 10, all of the downwardly-directed force of the skylight load passes downwardly through respective ones of the roof panels, ultimately through the respective roof panel ribs, along substantially the full length of the load, to underlying elements of the building support structure. As illustrated in FIG. 7, the load extends between the first and second rails across the entire width of the respective panel flat.

The rail shoulder 242 is shaped to fit closely over the outside of the roof rib 112, and FIG. 8, in combination with FIG. 6, shows the rail secured directly to roof rib 112 by a rivet 310. A rail support flange supports the skylight frame 132, where a sealant 330 can be applied to seal against the passage of water or air.

Figure 9:
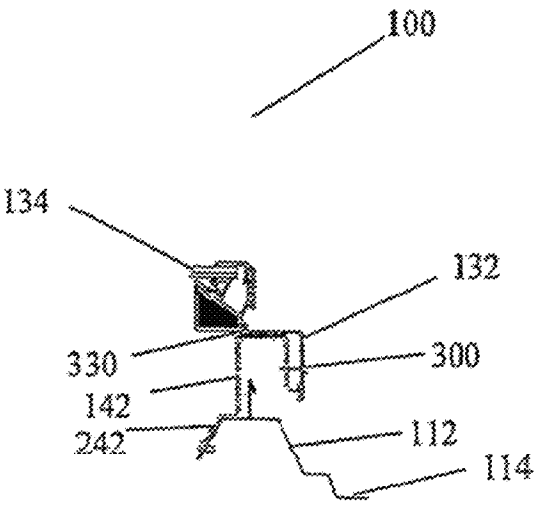
FIG. 9 is a cross sectional view showing an alternative arrangement for the elements shown in FIG. 8, only with the rail and closure structure connecting along the inner faces of adjacent rib elevations.
Figure 9:
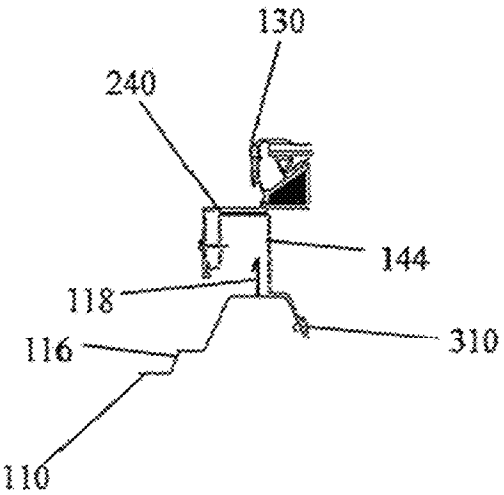

FIG. 9 depicts a variation of the rail and closure assembly 100 shown in FIG. 8, only where the rail shoulder 242 is shaped to fit closely along the inside of the roof rib 112, and is secured to roof rib 112 by rivet 310. As for FIG. 8, the rail bearing surface 240 similarly supports the skylight frame 132, where a sealant 330 can be applied.

It can be seen that the rail and closure structure 140 of the assembly 100 can be produced to fit closely along the contour of the roof 110, and can be so configured to have end portions that match the contour of the ribs 112. The various mating surfaces of the structure 140 and the roof 110 can be sealed in various ways known to the roofing art, including caulking or tape mastic, or various rubber fittings or inserts can be provided be used to seal the open area of the panel roof.

Figure 10:
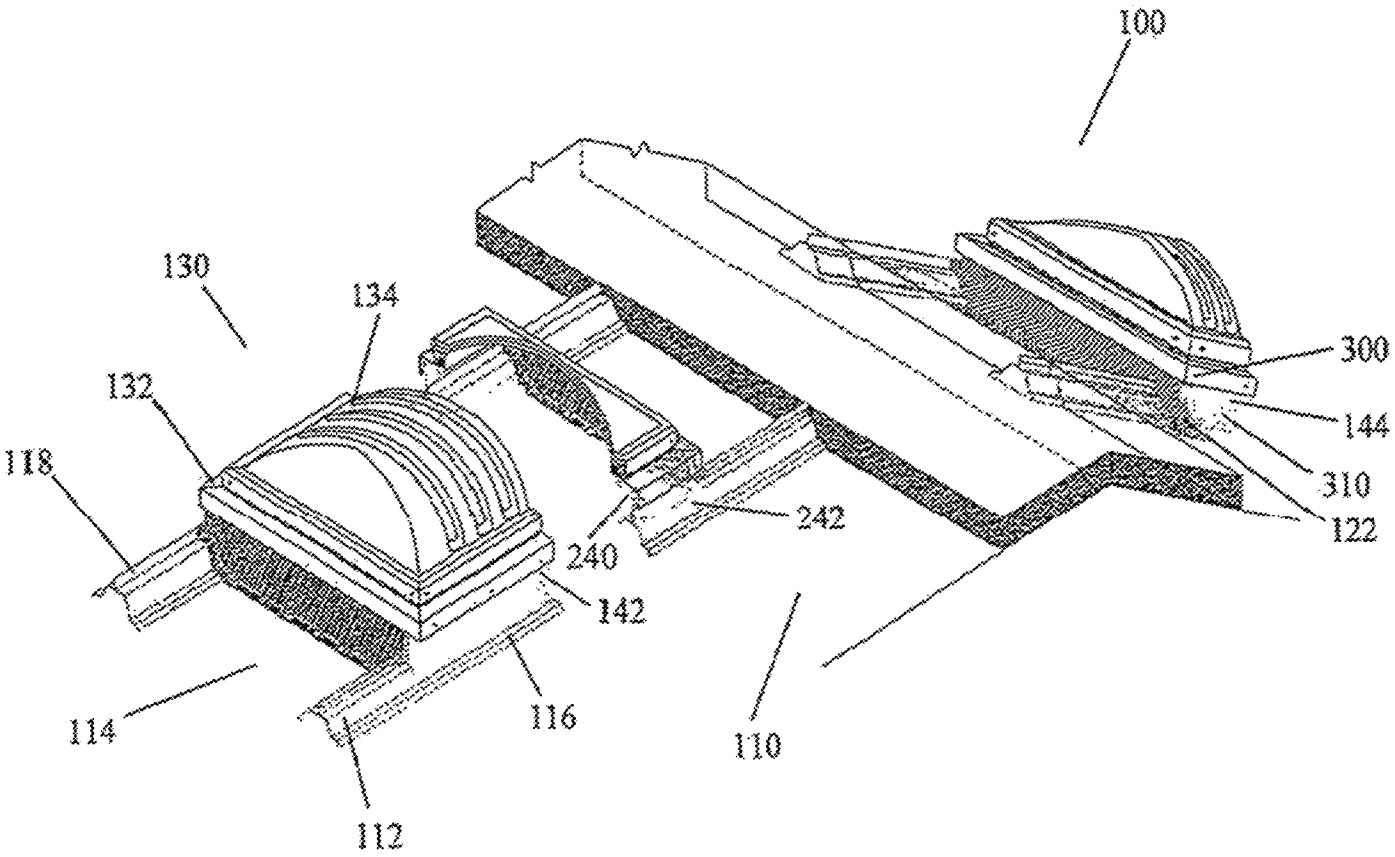
FIG. 10 is a perspective view partially cut away showing internal structure of the system as installed on the rib elevations of a metal roof.

In FIG. 10 a partially cut away perspective view of the rail and closure structure assembly 100 is used to show the support of the rail and closure system by the standing seam panel roof 110, particularly the elevated rib 112 providing the structural support. In FIG. 10, it is seen how the rail and closure system incorporates the structural profile of the upper panels of metal roof structure, the elevations and ribs used in sealing adjacent panels, to provide the support of adjacent skylights. In this fashion, the system adopts various advantages of a standing seam roof.

Most standing seam roofs are seamed using various clip assemblies that allow the roof to float, along the major elevation. Typically, the roof is fixed at cave and allowed to expand and contract over at ridge. Very wide roofs can be fixed at midspan and expand towards both the eave and ridge. The design of the skylight system takes full advantage of the floating features of contemporary roofing structures, and when a skylight is so secured to the elevations, the skylight assemblies themselves are able to draw strength from the structural load bearing capacity of the roof profile.

Shown in FIG. 10 is the panel flat 114, rib 112 and shoulder 116, as well as the standing seam 118. The ridge cap 120 is also shown, as well as the gap in the roof 122.

The skylight 130 is supported on the rail and closure structure 140, as previously described.

The rail and closure structure 140 is secured by its side rails 142 and 144 by a series of fasteners 300 to the skylight frame 132 and to the ribs 112 by a series of rivets 310.

In application, from each structure 140 a single rib 112 is typically cut away to accommodate drainage at the high end of the system (toward ridge cap 120). This is an important feature for standing seam, architectural standing seam and snap seam roofs. Two ribs may be cut for roofs having an "R" panel profile.

The retained portions of rib 112 serve as a beam to support the side rails 142 and 144 and maintain a watertight seal along the length of the assembly. Internal portions of the ribs 112 may be removed to allow additional light from the skylight 130.

A single bearing plate structure 148 is used for sealing the cut away rib. The bearing plate 148 also provides some support to link adjacent rib elevations 112, and is typically produced of steel or other material sufficient to provide a rigid substructure to the skylight rail and closure structure.

The rail and closure structure 140 is shaped in such a manner that the skylight can be easily fastened directly to the rail portion, with rivets or fasteners such as screws and the like. The rail and closure structure 140 may also be designed to accept a safety security guard before the skylight is installed.

Figure 12:
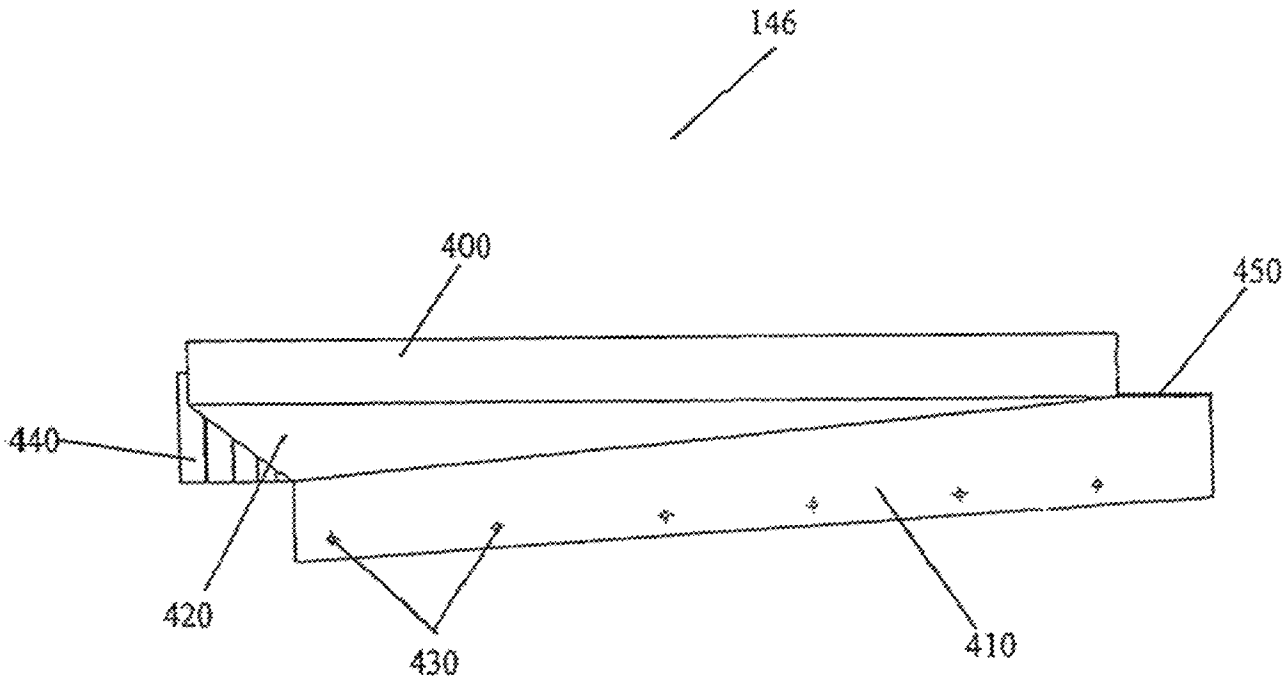
FIG. 12 is a top view of the upper rain pan or diverter of the rail and closure structure.
Figure 13:
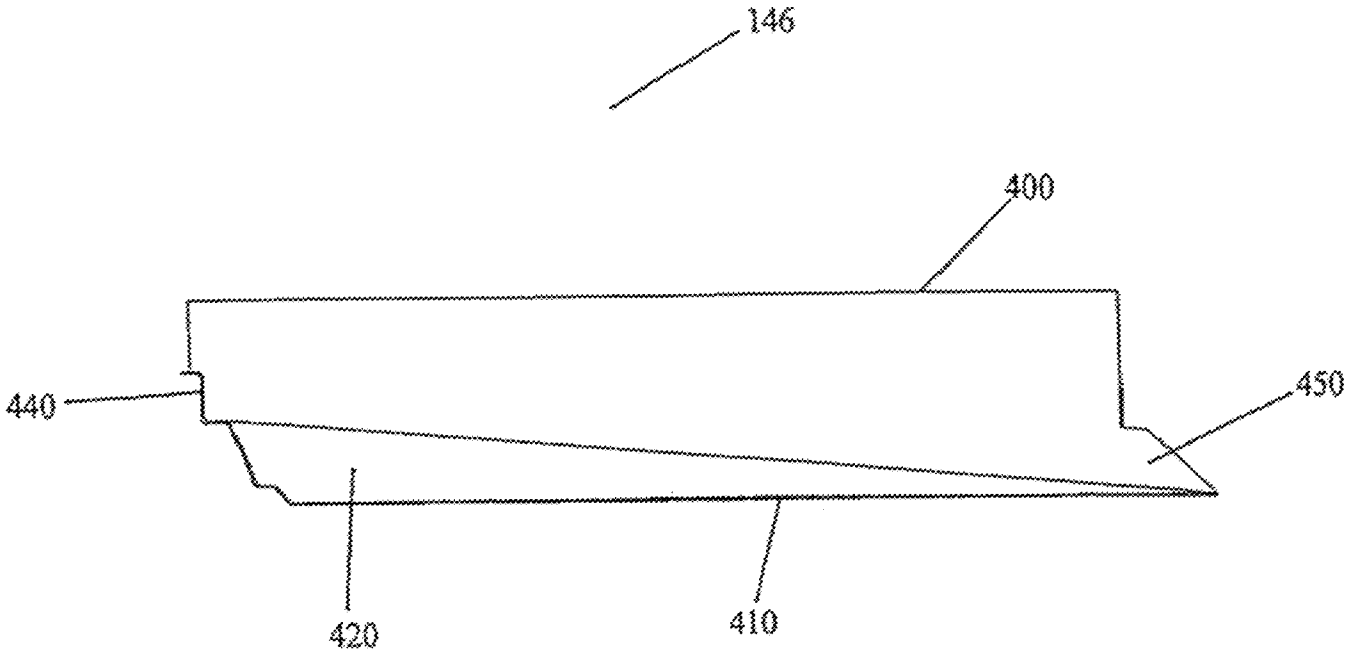
FIG. 13 is a front plan view of the upper rain pan or diverter of the rail and closure structure.

Looking now to FIGS. 11 through 13, an upper or high end diverter 146 provides closure and diversion of water around the top of the assembly to an adjacent panel flat. Diverter 146 also provides a weather tight seal at the upper end of the assembly, with the plate 148 (not shown). In reference to the side rails 142 and 144 of a standing seam panel roof 110, the diverter 146 generally fits the profile of the rib 112 at the region of the cut away gap 122. The side rails 142 and 144 abut the diverter 146 and the height of the diverter 146 closely matches them in height. The upper support flange 400 of the diverter 146 actually acts with upper support flanges 240 of the side rails 142 and 144 to form the bearing surface of the skylight frame.

The diverter 146 lower flange 410 runs along the panel flat 114. The diverter 146 also has a diversion surface 420 and fastener holes 430 along the lower flange.

At one end is a rib mating surface 440 and at the other a rib sealing plate 450 is formed.

Figure 14:
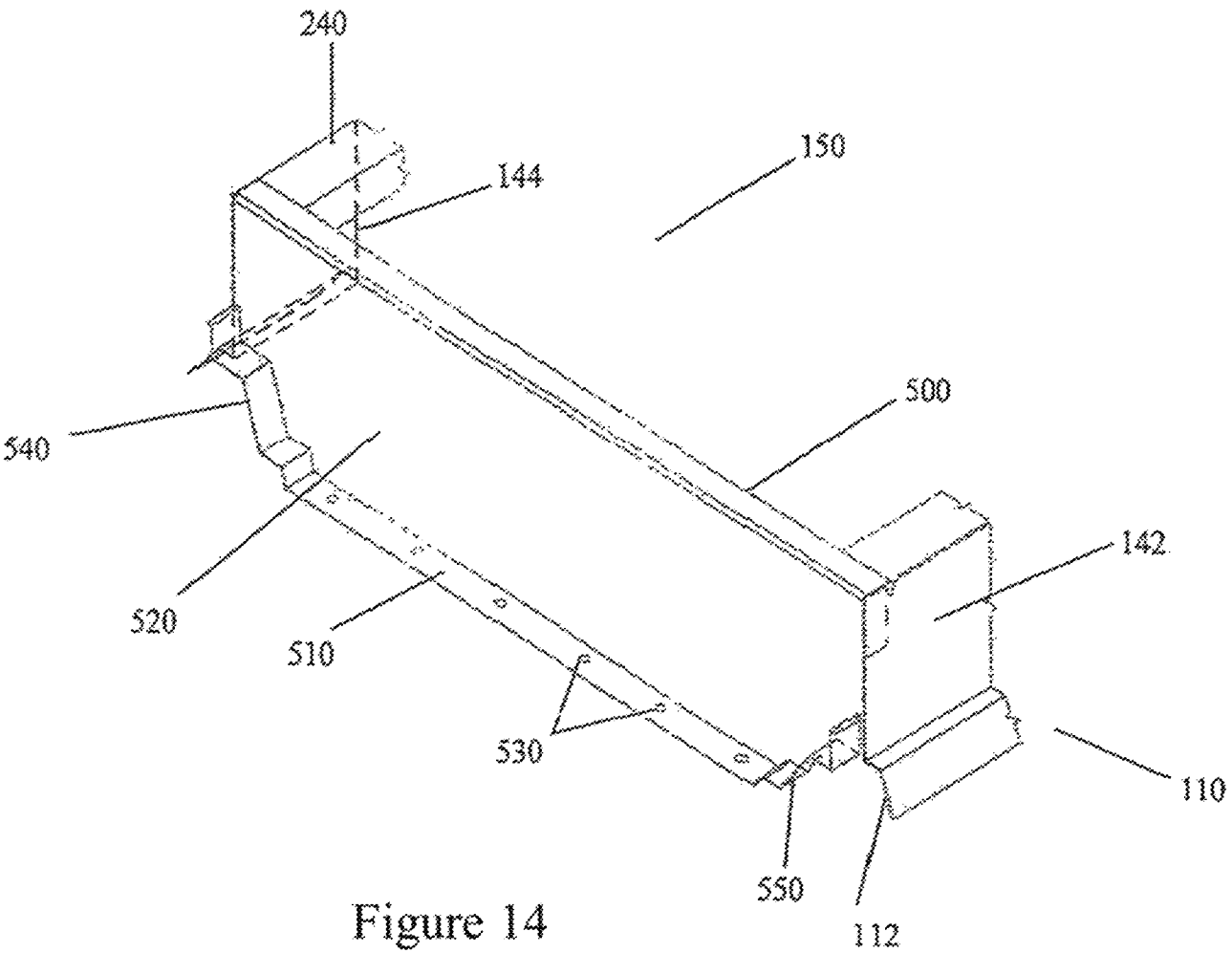
FIG. 14 is a perspective view of the lower rain pan or lower closure of the rail and closure structure.
Figure 15:
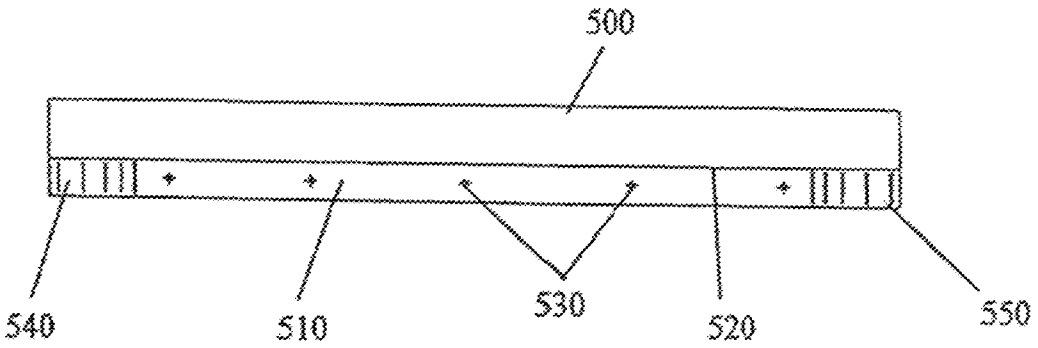
FIG. 15 is a top view of the lower rain pan or lower closure of the rail and closure structure.
Figure 16:
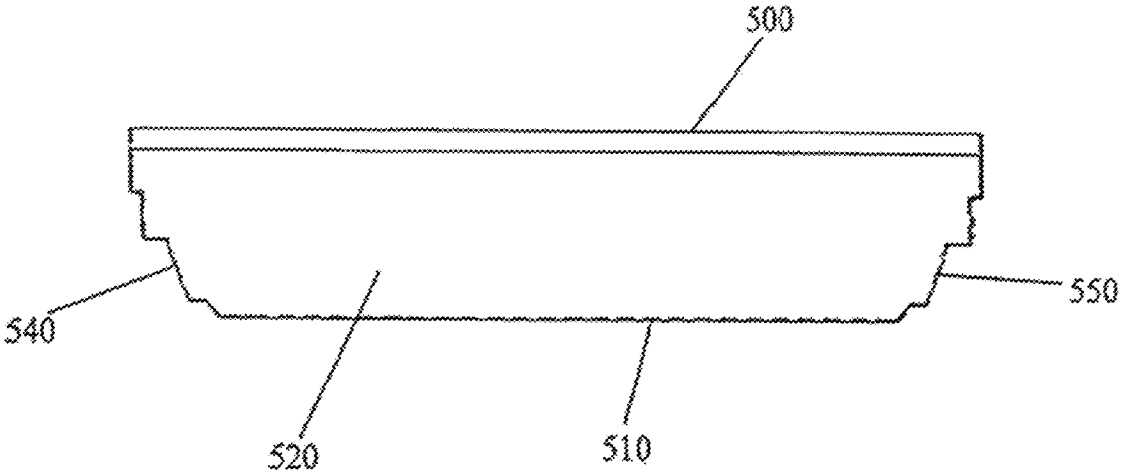
FIG. 16 is a front plan view of the lower rain pan or lower closure of the rail and closure structure.

FIGS. 14 through 16 show the low end closure 150 that is used to maintain a weather tight seal at the lower end of the assembly. Shown again in reference to the side rails 142 and 144 of a standing seam panel roof 110, the closure 150 is adapted to fit the profile of the rib 112. The side rails 142 and 144 abut the closure 150 and the height of the closure flange matches the height of flanges 240 of the side rails and the diverter, whereby the rail and support structure defines a plurality of support flanges having bearing surfaces all interfacing with said load at a common elevation above the panel flat of a respective next adjacent roof panel.

Looking to the closure 150, it is seen to have an upper support flange 500 and a lower flange 510, as well as a closure web 520. The lower flange 510 includes fastener holes 530.

The closure 150 also includes rib mating surfaces 540 and 550 to provide a tight fit along the ribs 112.

Figure 17:
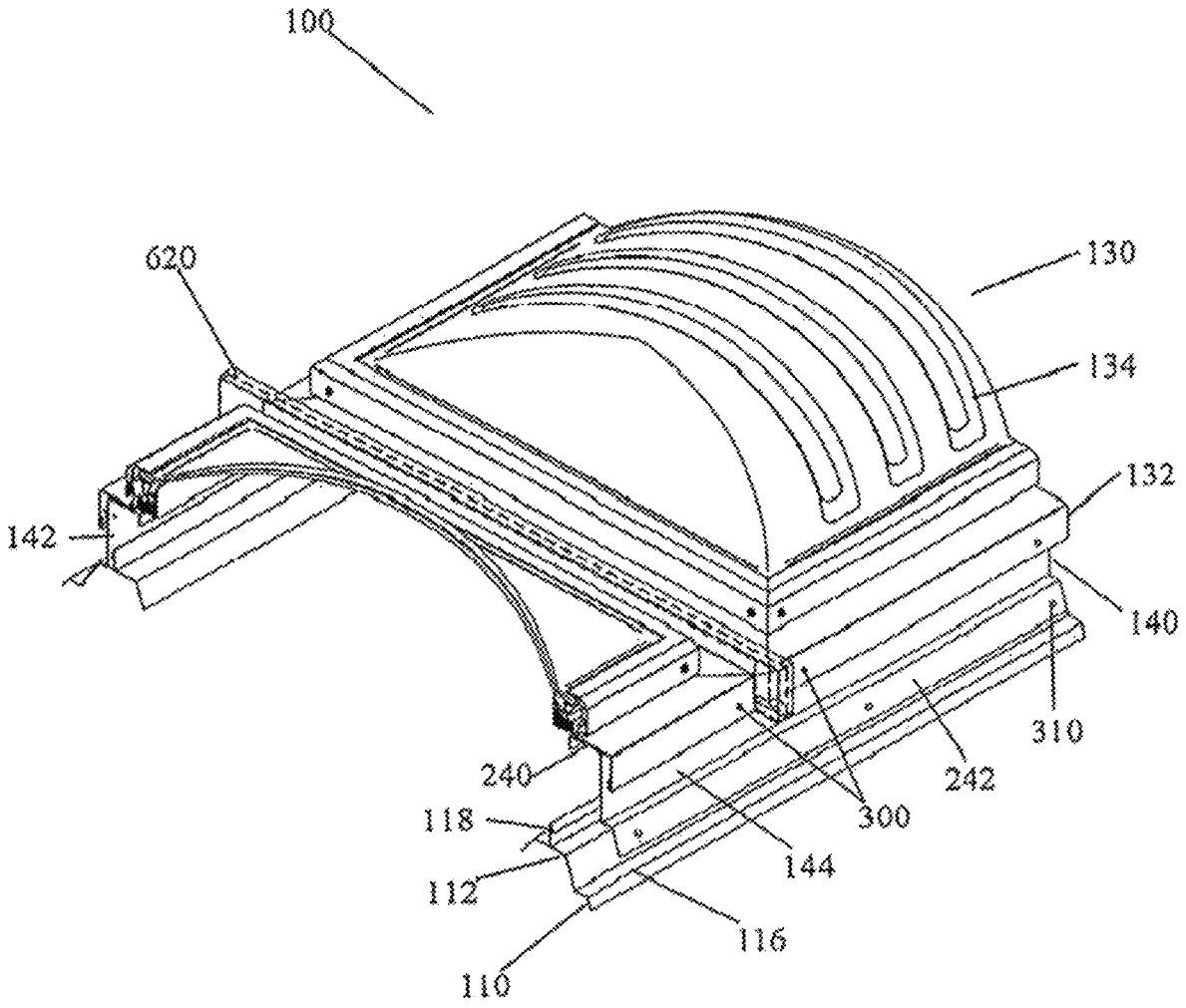
FIG. 17 is a perspective and partially cut away view showing a connection of adjacent skylights of the system.
Figure 18:
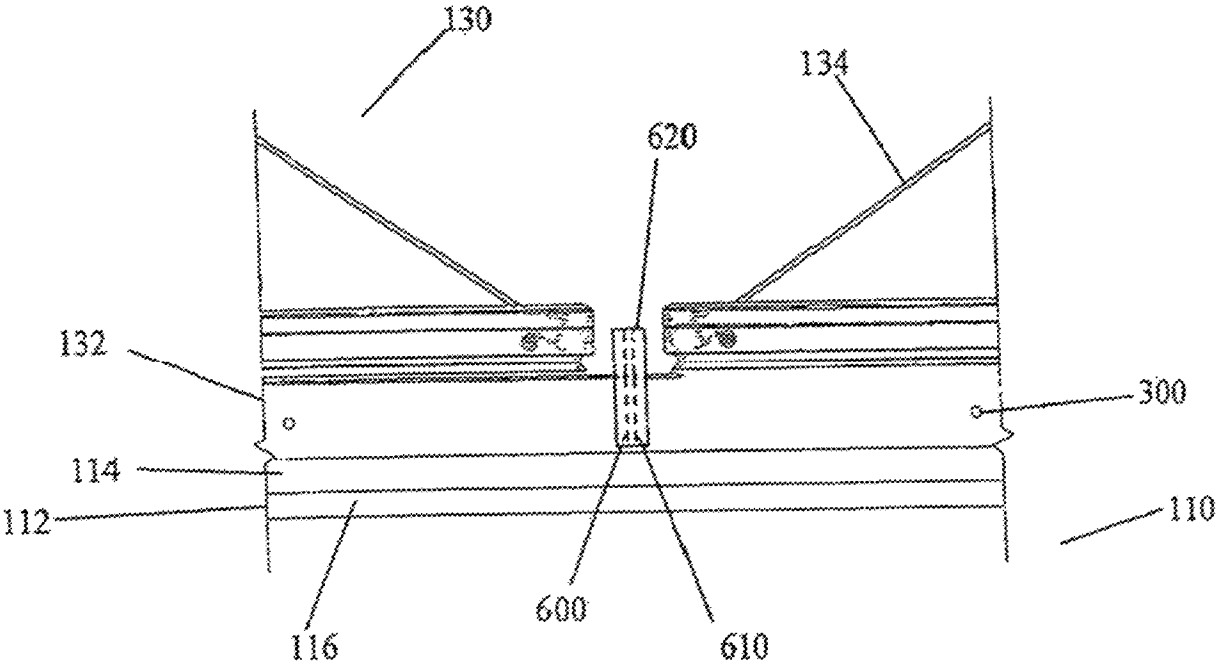
FIG. 18 shows detail of how the batten connects adjacent skylights and prevents water egress between them.

Looking now to FIGS. 17 and 18, the adaptation of the system for the application of multiple roof penetrating structures is described. A chief aspect of the assembly 100 is the reduction in the number of roof penetrations required to provide daylight to the interior of a structure, as fewer, longer cuts can be made along the roof elevations. These minimized openings can be maintained along a single rib, if desired, with one continuous opening versus many smaller ones permitting an equal or greater amount of ambient light into the building.

In the case of standing seam roofs the system provides the ability to remove only a portion of the bottom flat of the panel. This maintains the structural integrity of the roof in that multiple sections of major panel elevations are not removed, as is done to accommodate a "typical" curb assembly. Thus, the roof's structural integrity is not compromised to that extent and there are fewer potential areas for water infiltration, in that the skylight panels can be attached very near the ridge of the building and run to the eave requiring water to be diverted only once near the ridge of the roof plane and only across one panel flat.

To the limited extent that cutaways are made to the elevations, these are made small, on the order of a few inches or less, solely for the purpose of allowing drainage past the skylights.

The rail system is designed to install to either the inside or outside of the major rib elevation for any of the aforementioned roof panel profiles.

The rail and closure assembly 100 is particularly useful for continuous runs of skylights end to end. FIG. 17 shows how two adjacent skylights of the rail and closure assembly 100 can be affixed along a standing seam panel roof 110. Instead of producing the lights with diverters and lower closures, where adjacent lights abut, the rail and curb structures 140 are provided with upper and lower standing rib frames 600 and 610 at adjacent ends of the adjacent structures 140. A batten 620 is provided to secure the system 100 against the elements.

FIG. 18 is a side elevational view of the batten 620, showing how it fits over the adjacent upper and lower standing rib frames 600 and 610.

As only one example, skylights can be produced in units of up to 10 feet long, and connected in this fashion for as long as necessary, as each skylight unit is supported by the primary rib of the profile. The standing rib elevation (the major corrugation) runs longitudinally along the length of the assembly and mates along the entire assembly 100, regardless of the number of adjacent structures 140. No water can enter over the top of the rail and closure assembly.

Where it is desired that the skylight starts at the ridge of the roof, a simple flashing can be inserted under the ridge cap.

Where the ridge cap has a configuration to fit the rib elevations (major corrugations) in the roofing panels, a portion of the one rib may be cut out (approximately 2"), allowing the water from the roof panel above to be diverted on to the next panel.

If desired, a simple rail enclosure extension could be used to increase the height or distance between top skylight frame and the roof panel, and can be adapted to simply lay over or attach to the top of the rail and closure assembly. Such an extension could be produced to rest along the upper flange of the rail and closure assembly, to effectively raise the height of the skylight or smoke vent to accommodate different skylight depths or other design features, or to accommodate snow conditions and the like. In this fashion, the rail and closure structure can be produced to a standard height, with varying extensions used to elevate the overall height of the structure for such varied purposes. Various forms for such an extension would be suitable, and the skilled artisan will understand various ways and means of designing and manufacturing these to accomplish the goal of added height to the skylight.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A rail mounting system for mounting a skylight or other load on a metal panel roof in which elongate metal roof panels are arranged side by side, with edges of adjacent ones of the roof panels being joined to each other to define elevated roof panel ribs, and panel flats of the roof panels disposed between adjacent ones of the elevated ribs, the rail mounting system comprising:

a first side rail and a second side rail for supporting opposing sides of the skylight or other load, the first and second side rails each having a profile configured to attach to the elevated ribs and to provide structural support for the skylight or other load along substantially an entire length of the skylight or other load, the first and second side rails each including:

an upstanding riser, and a bottom shoulder structure extending from the upstanding riser, the bottom shoulder structure including a first shoulder element attached directly to the upstanding riser and extending along the length of the side rail, and laterally away from the upstanding riser, the first shoulder element having a first surface facing in a first direction having a downwardly-directed component, the bottom shoulder structure further including a second shoulder element attached directly to the first shoulder element, the second shoulder element extending in a second single direction, different from the first direction;

the rail mounting system further comprising:

an upper end element and a lower end element opposite the upper end element, the upper and lower end elements each extending across a panel flat of the metal panel roof and attached directly to the first side rail and to the second side rail.

2. The rail mounting system of claim 1, wherein the upper end element includes an upper flange adapted to support a portion of the skylight or other load.

3. The rail mounting system of claim 2, wherein the upper end element also includes a lower flange, and a plate that connects the lower flange to the upper flange.

4. The rail mounting system of claim 1, wherein the upper end element includes a lower flange, an upper flange, and a plate that connects the lower flange to the upper flange.

5. The rail mounting system of claim 1, wherein the upper end element includes a profiled portion that generally fits a profile of a given one of the elevated ribs.

6. The rail mounting system of claim 1, wherein the lower end element includes an upper flange adapted to support a portion of the skylight or other load.

7. The rail mounting system of claim 6, wherein the lower end element also includes a lower flange, and a web that connects the lower flange to the upper flange.

8. The rail mounting system of claim 1, wherein the lower end element includes a lower flange, an upper flange, and a web that connects the lower flange to the upper flange.

9. The rail mounting system of claim 1, wherein the lower end element includes a profiled portion corresponding to a profile of a given one of the elevated ribs.

10. A metal panel roof, comprising:

a metal panel roof in which elongate metal roof panels are arranged side by side, with edges of adjacent ones of the roof panels being joined to each other to define elevated roof panel ribs, and panel flats of the roof panels disposed between adjacent ones of the elevated ribs; and the rail mounting system of claim 1 mounted atop the metal panel roof.

11. A rail mounting system for mounting a skylight or other load on a metal panel roof in which elongate metal roof panels are arranged side by side, with edges of adjacent ones of the roof panels being joined to each other to define elevated roof panel ribs, and panel flats of the roof panels disposed between adjacent ones of the elevated ribs, the rail mounting system comprising:

a first side rail, a second side rail, a first transverse support member, and a second transverse support member;

wherein the first and second side rails are disposed opposite each other and spaced apart such that the first side rail extends along a first elevated rib of the metal panel roof and the second side rail extends along a different second elevated rib of the metal panel roof;

wherein the first side rail includes a first upstanding riser and a first bottom shoulder structure, the first bottom shoulder structure including a first shoulder element and a second shoulder element, the second shoulder element connected to the first upstanding riser through the first shoulder element, the first and second shoulder elements being angled relative to each other to fit closely over an angled profile of the first elevated rib;

wherein the second side rail includes a second upstanding riser and a second bottom shoulder structure, the second bottom shoulder structure including a third shoulder element and a fourth shoulder element, the fourth shoulder element connected to the second upstanding riser through the third shoulder element, the third and fourth shoulder elements being angled relative to each other to fit closely over an angled profile of the second elevated rib;

wherein the first and second transverse support members are disposed opposite each other, each such support member extending between and attached directly to the first and second side rails;

wherein the first side rail extends a first length from the first transverse support member to the second transverse support member, and the first bottom shoulder structure is configured to contact the first elevated rib entirely along the first length so that a first downward force from the skylight or other load is transmitted through the first side rail entirely along the first length; and wherein the second side rail extends a second length from the first transverse support member to the second transverse support member, and the second bottom shoulder structure is configured to contact the second elevated rib entirely along the second length so that a second downward force from the skylight or other load is transmitted through the second side rail entirely along the second length.

12. The rail mounting system of claim 11, wherein the first transverse support member includes an upper flange adapted to support a portion of the skylight or other load.

13. The rail mounting system of claim 12, wherein the first transverse support member also includes a lower flange, and a plate that connects the lower flange to the upper flange.

14. The rail mounting system of claim 11, wherein the first transverse support member includes a lower flange, an upper flange, and a plate that connects the lower flange to the upper flange.

15. The rail mounting system of claim 11, wherein the first transverse support member includes a profiled portion that generally fits a profile of a given one of the elevated ribs.

16. The rail mounting system of claim 11, wherein the second transverse support member includes an upper flange adapted to support a portion of the skylight or other load.

17. The rail mounting system of claim 16, wherein the second transverse support member also includes a lower flange, and a web that connects the lower flange to the upper flange.

18. The rail mounting system of claim 11, wherein the second transverse support member includes a lower flange, an upper flange, and a web that connects the lower flange to the upper flange.

19. The rail mounting system of claim 11, wherein the second transverse support member includes a profiled portion corresponding to a profile of a given one of the elevated ribs.

20. A metal panel roof, comprising:

a metal panel roof in which elongate metal roof panels are arranged side by side, with edges of adjacent ones of the roof panels being joined to each other to define elevated roof panel ribs, and panel flats of the roof panels disposed between adjacent ones of the elevated ribs; and the rail mounting system of claim 11 mounted atop the metal panel roof.

* * * * *